US010127870B2

(12) United States Patent
Yang et al.

(10) Patent No.: US 10,127,870 B2
(45) Date of Patent: Nov. 13, 2018

(54) LIQUID CRYSTAL DISPLAY HAVING TWO EQUAL COMMON VOLTAGES AT TWO OPPOSITE SIDES

(71) Applicant: AU Optronics Corp., Hsin-Chu (TW)

(72) Inventors: Min-I Yang, Hsin-Chu (TW); Chang-Hui Wu, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 349 days.

(21) Appl. No.: 15/064,613

(22) Filed: Mar. 9, 2016

(65) Prior Publication Data

US 2016/0343339 A1 Nov. 24, 2016

(30) Foreign Application Priority Data

May 21, 2015 (TW) ..... 104116210 A

(51) Int. Cl.

*G09G 5/00* (2006.01)
*G09G 3/36* (2006.01)
*G05F 3/26* (2006.01)

(52) U.S. Cl.

CPC ..... *G09G 3/3655* (2013.01); *G05F 3/26* (2013.01); *G09G 3/3696* (2013.01); *G09G 2320/0223* (2013.01); *G09G 2330/025* (2013.01)

(58) Field of Classification Search

CPC ..... G09G 3/3696; G09G 3/3655; G05F 3/26
USPC ..... 345/211
See application file for complete search history.

(56) References Cited

U.S. PATENT DOCUMENTS

| | | | | |
|---|---|---|---|---|
| 8,248,394 | B2 | 8/2012 | Toyooka | |
| 8,390,552 | B2 | 3/2013 | Miyashita | |
| 2001/0011984 | A1* | 8/2001 | Hong | G09G 3/3655 345/92 |
| 2007/0152943 | A1* | 7/2007 | Hwang | G02F 1/13306 345/98 |
| 2008/0291146 | A1* | 11/2008 | Feng | G09G 3/3655 345/92 |
| 2009/0015528 | A1* | 1/2009 | Sheu | G09G 3/3655 345/87 |

(Continued)

FOREIGN PATENT DOCUMENTS

| | | |
|---|---|---|
| CN | 101676987 | 3/2010 |
| CN | 101847376 A | 9/2010 |
| TW | 201501111 A | 1/2015 |

OTHER PUBLICATIONS

State Intellectual Property Office of the P. R. C, "Office Action", dated Dec. 2, 2016, China.

*Primary Examiner* — Adam J Snyder
(74) *Attorney, Agent, or Firm* — Locke Lord LLP; Tim Tingkang Xia, Esq.

(57) ABSTRACT

A liquid crystal display includes a pixel array, a gate driver, a data driver, a common voltage source, and a current duplication module. The gate driver is used to turn on a plurality of rows of pixels in the pixel array in sequence. The data driver is used to provide a plurality of data voltages to the turned-on pixels in the pixel array. The common voltage source is used to provide a common voltage. The current duplication module is coupled to a first side and a second side of the pixel array and is used to input two substantially equal currents to the first side and the second side of the pixel array respectively to provide the common voltage to the first side and the second side of the pixel array.

10 Claims, 2 Drawing Sheets

(56) References Cited

U.S. PATENT DOCUMENTS

| | | | | |
|---|---|---|---|---|
| 2009/0128536 | A1* | 5/2009 | Seo | G09G 3/3655 345/211 |
| 2010/0073341 | A1* | 3/2010 | Toyooka | G09G 3/3614 345/208 |
| 2010/0245326 | A1* | 9/2010 | Xiao | G09G 3/3655 345/211 |
| 2010/0309183 | A1* | 12/2010 | Mizusako | G09G 3/3648 345/208 |
| 2011/0148826 | A1* | 6/2011 | Koyama | G09G 3/3696 345/204 |
| 2013/0307761 | A1* | 11/2013 | Kwak | G09G 3/3696 345/87 |
| 2014/0028535 | A1* | 1/2014 | Min | G09G 3/18 345/87 |
| 2015/0062471 | A1* | 3/2015 | Sung | G09G 3/3655 349/33 |

* cited by examiner

LIQUID CRYSTAL DISPLAY HAVING TWO EQUAL COMMON VOLTAGES AT TWO OPPOSITE SIDES

BACKGROUND OF THE INVENTION

1. Field of the Invention

This invention relates to a liquid crystal display, and more particularly, to a liquid crystal display that is able to input a common voltage from two different sides of the liquid crystal display.

2. Description of the Prior Art

Generally, liquid crystal displays may control orientations of liquid crystals to present images by changing voltages applied to the liquid crystals. To avoid losing accurate control of rotation angles of liquid crystals caused by the voltage applied to the liquid crystals with the same polarity for a long time, a conventional crystal liquid display is usually controlled with a polarity inversion approach. Since the voltage applied on liquid crystals is the voltage difference between a data voltage and a common voltage, the liquid crystal display may switch the data voltage between a high voltage level and a low voltage level so that the polarity of the voltage applied to liquid crystals is switched periodically to avoid the liquid crystals from being controlled by a bias voltage of the same polarity for a long time.

In the prior art, when the common voltage is inputted to a side of a pixel array, a common voltage of a pixel far away from the input point of the common voltage would be different from a common voltage of a pixel close to the input point of the common voltage due to voltage decay of the common voltage along the trace, resulting in deteriorating the image quality. To avoid this issue, a conventional liquid crystal display receives a common voltage from two opposite sides to the pixel array. However, the traces along which the common voltage is transmitted to the upper side and the lower side of the pixel array have different lengths, resulting in the pixel array having two different common voltages at the two opposite sides, causing uneven brightness and inconsistent flicker contrast ratio, and generating mura on the liquid crystal display.

SUMMARY OF THE INVENTION

The present invention discloses a liquid crystal display. The liquid crystal display comprises a pixel array, a gate driver, a data driver, a common voltage source and a current duplication module. The gate driver is used to provide a plurality of gate pulses to turn on a plurality of rows of pixels in the pixel array sequentially. The data driver is used to provide a plurality of data voltages to turned-on pixels in the pixel array. The common voltage source is used to provide a common voltage. The current duplication module is connected between the common voltage source and a first side and a second side of the pixel array. The current duplication module is used to input two substantially equal currents to the first side and the second side of the pixel array, respectively, to provide the common voltage to the first side and the second side of the pixel array. In addition, the first side and the second side of the pixel array are two opposite sides of the pixel array.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
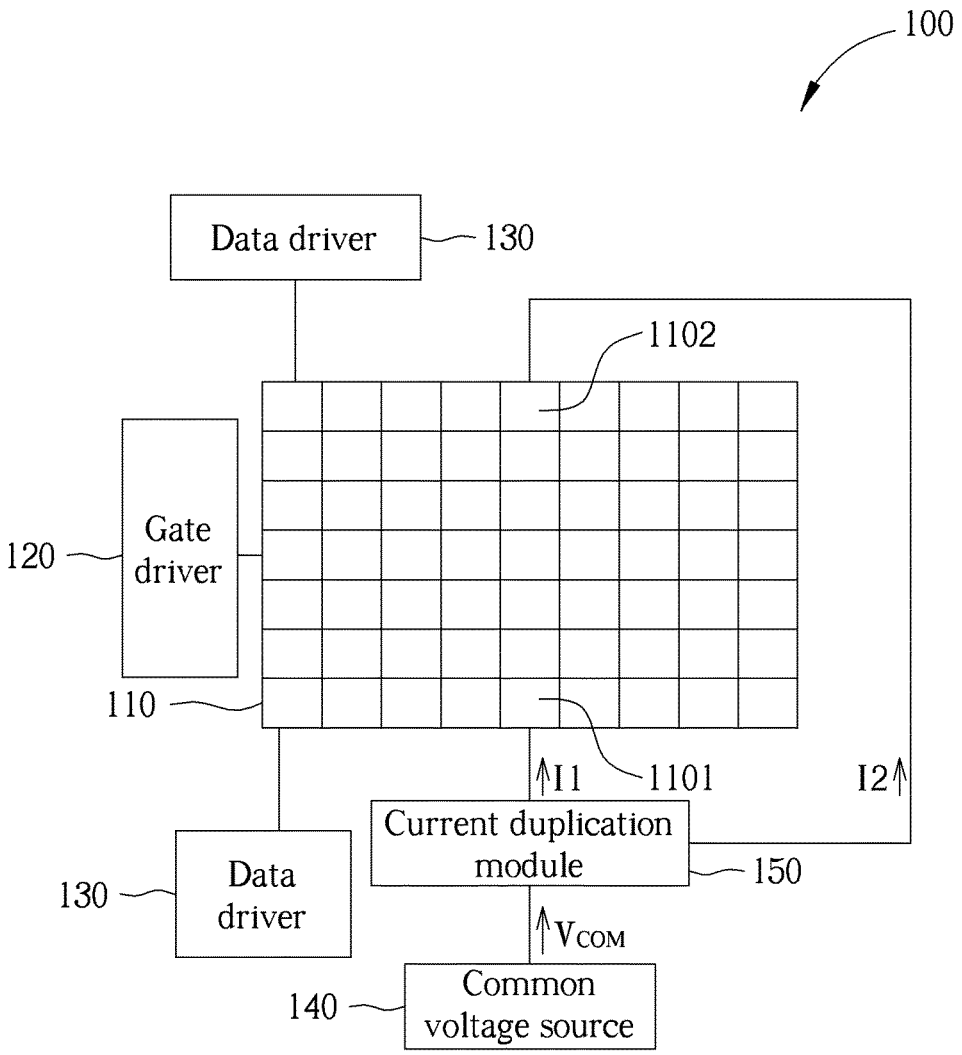
FIG. 1 shows a liquid crystal display according to one embodiment of the present invention.

FIG. 1 shows a liquid crystal display 100 according to one embodiment of the present invention. The liquid crystal display 100 includes a pixel array 110, a gate driver 120, a data driver 130, a common voltage source 140 and a current duplication module 150. The pixel array 110 includes a plurality of rows of pixels. The gate driver 120 can provide a plurality of gate pulses to turn on the plurality of rows of pixels in the pixel array 110 sequentially. The data driver 130 can provide a plurality of data voltages to the pixels in the pixel array 110 turned on by the gate pulses. The common voltage source 140 can provide a common voltage $V_{COM}$. The current duplication module 150 is connected between the common voltage source 140 and the pixel array 110. Furthermore, the current duplication module 150 is connected to a first side of the pixel array 110 and a second side of the pixel array 110. The first side and the second side of the pixel array 110 are two opposite sides of the pixel array 110. After the common voltage $V_{COM}$ is adjusted to an optimum value, the common voltage $V_{COM}$ can be inputted to the first side of the pixel array 110 through the current duplication module 150, and the current flowing into the first side of the pixel array 110 is I1. The current duplication module 150 can generate a current I2 by duplicating the current I1 and input the current I2 to the second side of the pixel array 110. That is, the current duplication module 150 can input two substantially equal currents I1 and I2 to the first side and the second side of the pixel array 110 to provide the common voltage $V_{COM}$ to the first side and the second side of the pixel array, respectively. In some embodiments of the present invention, the common voltage $V_{COM}$ can be applied to the common electrode of an upper substrate of the liquid crystal display 100. However, in other embodiments of the present invention, the common voltage $V_{COM}$ can be applied to the common electrode of an array substrate of the liquid crystal display 100. In some embodiments of the present invention, the current duplication module 150 can be implemented by a current mirror. Due to the symmetrical structure of the pixel array 110, an effective resistance on a path of the current I1 flowing through after the current I1 inputted from the first side of the pixel array 110 to the pixel 1101 is substantially equal to an effective resistance on a path of the current I2 flowing through after the current I2 inputted from the second side of the pixel array 110 to the pixel 1102. In some embodiments of the present invention, if the effective resistance of the current I1 flowing through the pixel array 110 and the effective resistance of the current I2 flowing through the pixel array 110 are both R, then a voltage (I1×R) received by the pixel 1101 close to the first side of the pixel array 110 would be substantially equal to a voltage (I2×R) received by the pixel 1102 close to the second side of the pixel array 110 when the current duplication module 150 is utilized to input the common voltage $V_{COM}$ into the first side and the second side of the pixel array 110. Since the current duplication module 150 can adjust the current I2 to be substantially equal to the current I1. That is, the different IR drops of the path from the common voltage source 140 to the first side of the pixel array 110 and the path from the common voltage source 140 to the second side of the pixel array 110 will no longer cause the voltages received by the pixel 1101 and 1102 to be different, preventing uneven brightness shown on the panel when displaying images.

Figure 2:
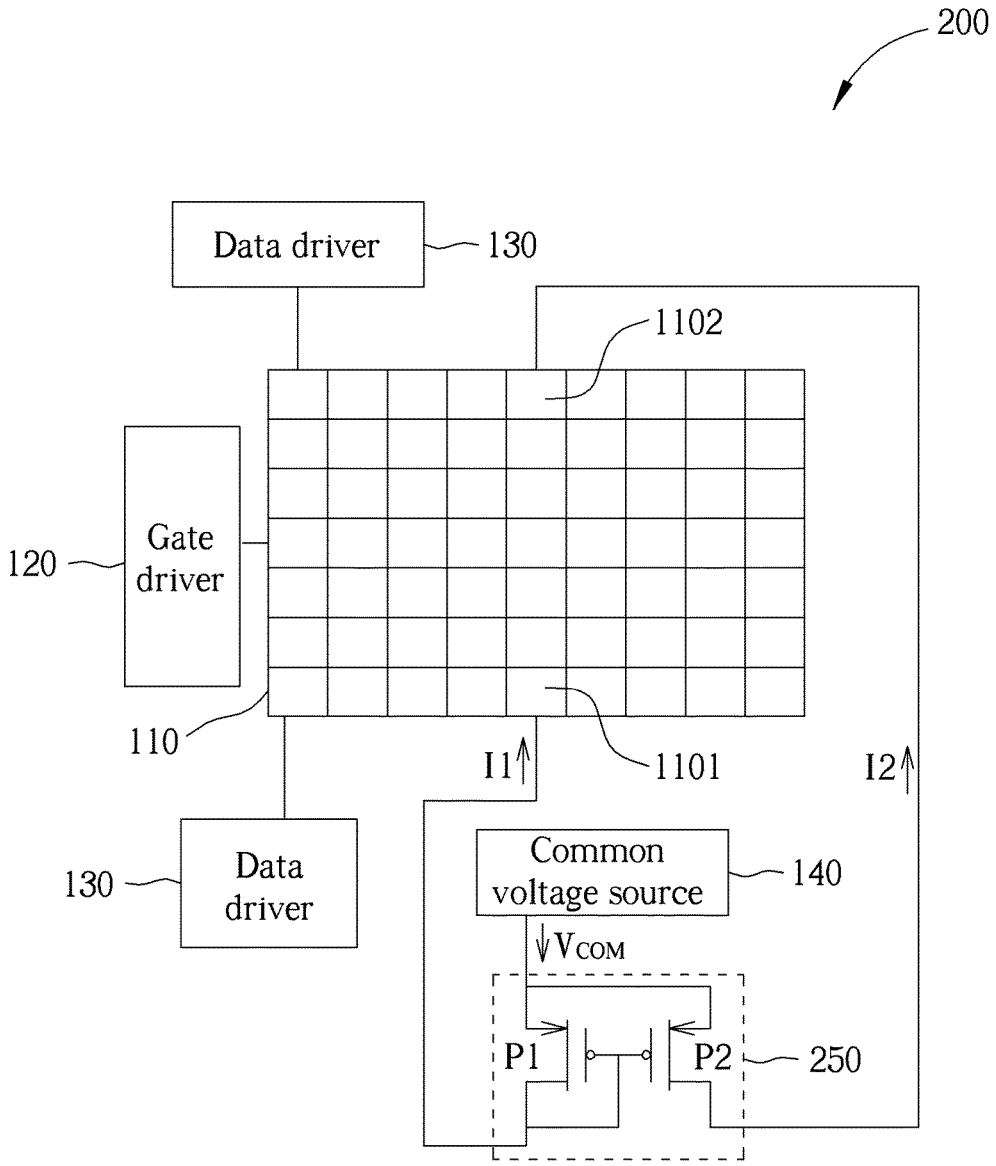
FIG. 2 shows a liquid crystal display according to another embodiment of the present invention.

FIG. 2 shows a liquid crystal display 200 according to one embodiment of the present invention. The liquid crystal display 200 is similar to the liquid crystal display 100. In the liquid crystal display 200, the current duplication module 250 is implemented by a current mirror. The current duplication module 250 includes a first P type transistor P1 and a second P type transistor P2. The first P type transistor P1 has a first terminal, a second terminal and a control terminal. The first terminal of the first P type transistor P1 is coupled to the common voltage source 140 for receiving the common voltage $V_{COM}$, the second terminal of the first P type transistor P1 is coupled to the first side of the pixel array 110, and the control terminal of the first P type transistor P1 is coupled to the second terminal of the first P type transistor P1. The second P type transistor P2 has a first terminal, a second terminal and a control terminal. The first terminal of the second P type transistor P2 is coupled to the first terminal of the first P type transistor P1 for receiving the common voltage $V_{COM}$, the second terminal of the second P type transistor P2 is coupled to the second side of the pixel array 110, and the control terminal of the second P type transistor P2 is coupled to the control terminal of the first P type transistor P1.

In some embodiments of the present invention, to ensure the first P type transistor P1 and the second P type transistor P2 to be operated in the saturation mode, the common voltage $V_{COM}$ can be greater than voltages received by the first side and the second side of the pixel array 110, and the absolute values of the gate to source voltages of the first P type transistor P1 and the second P type transistor P2 can be greater than the absolute values of the threshold voltages of the first P type transistor P1 and the second P type transistor P2. When the first P type transistor P1 and the second P type transistor P2 are operated in the saturation mode, the currents flowing through the first P type transistor P1 and the second P type transistor P2 can be independent from the drain to source voltages of the first P type transistor P1 and the second P type transistor P2, but only dependent on the gate to source voltages. Since the first terminal of the first P type transistor P1 and the first terminal of the second P type transistor P2 are coupled together and have the same voltage level, and the control terminal of the first P type transistor P1 and the control terminal of the second P type transistor P2 are coupled together and have the same voltage level, the first P type transistor P1 and the second P type transistor P2 together form a current mirror. In this case, the current I1 flowing through the first P type transistor P1 is substantially equal to the current I2 flowing through the second P type transistor P2.

In some embodiments of the present invention, to ensure the currents I1 and I2 flowing to the first and second sides of the pixel array 110 to be equal, a ratio of channel width to channel length of the first P type transistor P1 is the same as a ratio of channel width to channel length of the second P type transistor P2 in FIG. 2.

By using the current duplication module 250 of the liquid crystal display 200, two substantially equal currents can be inputted to the first and the second sides of the pixel array 110 respectively. In this case, the voltages received by the first and second sides of the pixel array 110 will also be substantially equal. That is to say, since the currents outputted by the current duplication module 250 are independent from the lengths and the resistances of the traces the currents flowing through, the IR drops of the trace from the common voltage source 140 to the first side of the pixel array 110 and the trace from the common voltage source 140 to the second side of the pixel array 110 would be substantially the same, preventing uneven brightness shown on the panel when displaying images.

Table 1 shows flicker contrast ratios of the pixels 1101 and 1102 when using the liquid crystal display of prior art to drive the pixel array 110 and when using the liquid crystal display 100 or 200 to drive the pixel array 110.

TABLE 1

| Flicker contrast ratio | Liquid crystal display 100 | Liquid crystal display of prior art |
|---|---|---|
| Pixel 1101 | 7.2% | 23% |
| Pixel 1102 | 7% | 7.4% |

The second column of table 1 shows the flicker contrast ratios of the pixels 1101 and 1102 when using the liquid crystal display 100 or 200 to drive the pixel array 110, and the third column of the table 1 shows the flicker contrast ratios of the pixels 1101 and 1102 when using the liquid crystal display of prior art to drive the pixel array 110. Since the liquid crystal display of prior art does not input the common voltage $V_{COM}$ by using the current duplication module to produce the same currents, the voltages received by the pixels 1101 and 1102 are dependent on a distance between the pixel 1101 and the common voltage source and a distance between the pixel 1102 and the common voltage source when using the liquid crystal display of prior art to drive the pixel array 110. To optimize the flicker contrast ratio of a central pixel of the pixel array 110, the pixel 1101 may receive a greater voltage than the pixel 1102 due to the shorter path from the pixel 1101 to the common voltage $V_{COM}$, which causes the flicker contrast ratio of the pixel 1101 to be at 23%, significantly higher than the flicker contrast ratio of the pixel 1102 at 7.4%.

Contrarily, when using the liquid crystal display 100 to drive the pixel array 110, the flicker contrast ratio of the pixel 1101 is at 7.2%, which is almost same as the flicker contrast ratio of the pixel 1102 at 7%. Namely, the uneven brightness and inconsistent flicker contrast ratio of the liquid crystal displays 100 and 200 caused by the different distances of the pixels 1101 and 1102 to the common voltage source 140 can be significantly reduced.

In summary, the liquid crystal display according to the embodiments of the present invention can input the common voltage to the pixel array by using a current duplication module to avoid uneven brightness and inconsistent flicker contrast ratios caused by different distances of pixels at different positions to the common voltage source.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A liquid crystal display comprising:

a pixel array;

a gate driver configured to provide a plurality of gate voltages to turn on a plurality of rows of pixels in the pixel array sequentially;

a data driver configured to provide a plurality of data voltages to the turned-on pixels in the pixel array;

a common voltage source configured to provide a common voltage; and a current duplication module coupled to the common voltage source, a first side of the pixel array, and a second side of the pixel array, and configured to input two substantially equal currents to the first side and the second side of the pixel array respectively to provide the common voltage to the first side and the second side of the pixel array;

wherein the current duplication module is a current mirror, and the first side and the second side of the pixel array are two opposite sides of the pixel array.

2. The liquid crystal display of claim 1, wherein the current duplication module comprises:

a first P type transistor having a first terminal coupled to the common voltage source, a second terminal coupled to the first side of the pixel array, and a control terminal coupled to the second terminal of the first P type transistor; and a second P type transistor having a first terminal coupled to the first terminal of the first P type transistor, a second terminal coupled to the second side of the pixel array, and a control terminal coupled to the control terminal of the first P type transistor.

3. The liquid crystal display of claim 2, wherein a ratio of channel width to channel length of the first P type transistor is same as a ratio of channel width to channel length of the second P type transistor.

4. The liquid crystal display of claim 1, wherein a first effective resistance on a path after a current inputted into the first side of the pixel array from the current duplication module is substantially equal a second effective resistance on a path after a current inputted into the second side of the pixel array from the current duplication module.

5. The liquid crystal display of claim 1, wherein the common voltage source is applied to a common voltage electrode of an upper substrate of the liquid crystal display or a common voltage electrode of an array substrate of the liquid crystal display.

6. A liquid crystal display comprising:

a pixel array;

a gate driver configured to provide a plurality of gate voltages to turn on a plurality of rows of pixels in the pixel array sequentially;

a data driver configured to provide a plurality of data voltages to the turned-on pixels in the pixel array;

a common voltage source configured to provide a common voltage; and a current duplication module coupled to the common voltage source, a first side of the pixel array, and a second side of the pixel array, and configured to input two substantially equal currents to the first side and the second side of the pixel array respectively to provide the common voltage to the first side and the second side of the pixel array;

wherein the first side and the second side of the pixel array are two opposite sides of the pixel array, and wherein the current duplication module comprises:

a first P type transistor having a first terminal coupled to the common voltage source, a second terminal coupled to the first side of the pixel array, and a control terminal coupled to the second terminal of the first P type transistor; and a second P type transistor having a first terminal coupled to the first terminal of the first P type transistor, a second terminal coupled to the second side of the pixel array, and a control terminal coupled to the control terminal of the first P type transistor.

7. The liquid crystal display of claim 6, wherein a ratio of channel width to channel length of the first P type transistor is same as a ratio of channel width to channel length of the second P type transistor.

8. The liquid crystal display of claim 6, wherein the current duplication module is a current mirror.

9. The liquid crystal display of claim 6, wherein a first effective resistance on a path after a current inputted into the first side of the pixel array from the current duplication module is substantially equal a second effective resistance on a path after a current inputted into the second side of the pixel array from the current duplication module.

10. The liquid crystal display of claim 6, wherein the common voltage source is applied to a common voltage electrode of an upper substrate of the liquid crystal display or a common voltage electrode of an array substrate of the liquid crystal display.

* * * * *